United States Patent [19]

Pombo

[11] 4,249,678

[45] Feb. 10, 1981

[54] COMBINED CLOSURE AND DISPENSING CONTROL TOP FOR CONTAINERS

[76] Inventor: Jorge Pombo, Juan Leon Mera 1414 y Colon 1° ofic. A, Quito, Ecuador

[21] Appl. No.: 39,291

[22] Filed: May 15, 1979

[51] Int. Cl.[3] ..... B65D 47/10

[52] U.S. Cl. ..... 222/409; 222/149; 222/510; 222/541; 222/561

[58] Field of Search ..... 222/149, 153, 409, 510, 222/541, 547, 568, 570, 559, 561

[56] References Cited

U.S. PATENT DOCUMENTS

| | | | |
|---|---|---|---|
| 1,214,971 | 2/1917 | Tibbals | 222/547 |
| 1,471,291 | 10/1923 | Schling | 222/559 |
| 2,263,731 | 11/1941 | Hynek | 222/559 |
| 2,268,964 | 1/1942 | Saffell | 222/541 X |
| 2,637,468 | 5/1953 | Wekerle | 222/409 X |

FOREIGN PATENT DOCUMENTS

| | | | |
|---|---|---|---|
| 188192 | 3/1972 | Argentina . | |
| 1347225 | 11/1963 | France | 222/559 |

*Primary Examiner*—Joseph J. Rolla
*Assistant Examiner*—Fred A. Silverberg
*Attorney, Agent, or Firm*—Fleit & Jacobson

[57] ABSTRACT

A combined closure and dispensing control top for closing containers and for controlling the rate of dispensing of the contents of the containers when inverted. The top has a housing defining a body member with fore and ejection chambers interconnected by a passageway. A closure member has a piston portion positioned for sliding movement within the ejection chamber for controlling the effective size of the passageway. The piston portion is movable between a blocking position closing the passageway and a dispensing control position which determines the effective size of the passageway. The ejection chamber has front and rear openings, with the front opening being closable by an intermediate portion projecting forwardly from the piston portion. Prior to initial dispensing from the container, the closure and dispensing control member has an enlarged portion positioned outside of the housing and connected to the intermediate portion. The enlarged portion has a size greater than the diameter of the front opening in the ejection chamber and provides a visual indication that the container has not been previously used. The closure and dispensing control member also has a portion extending rearwardly from the piston portion through the rear opening of the injection chamber. This portion terminates in an enlarged end that can be grasped by a user to move the piston portion. Initial movement of the piston portion rearwardly separates the enlarged front portion from the intermediate portion. The closure and dispensing control member includes an axially extending bore that admits air into the ejection chamber during dispensing.

6 Claims, 5 Drawing Figures

COMBINED CLOSURE AND DISPENSING CONTROL TOP FOR CONTAINERS

BACKGROUND OF THE INVENTION

1. Field of the Invention

The present invention relates to a combined closure and dispensing control member or top for containers whose contents are dispensed by inverting the containers.

2. Summary of the Invention

The present invention provides a combined closure member and dispensing control or flow regulating top for containers. The dispensing top has a housing defining a body member and a piston member slidably movable within an ejection chamber formed within the body member. The body member also has a fore chamber that is screw fitted or press fitted on to the top of the container and connected to the ejection chamber by a passageway. A portion of the piston member is movable within the ejection chamber to selectively block and control the size of the passageway. Leading and trailing portions of the piston member extend outside the ejection chamber through aligned front and rear openings formed in the housing. Prior to initial opening of the container, an enlarged portion of the leading portion of the piston member extends outside of the ejection chamber to both block the opening and to provide a visual indication that the container has not been previously used. When the container is first used, rearward movement of the piston member separates the enlarged portion from the remainder of the leading portion, so that a subsequent user can visually ascertain whether or not the container has been previously used. The piston member is subsequently movable between a blocking position in which a portion of the member blocks communication between the fore chamber and the ejection chamber and a flow regulating position in which a portion of the piston member controls the size of the passageway between the fore and the ejection chambers. Movement of the piston member from its flow regulating to its blocking position results in self-cleaning of the ejection chamber. Also, when in the blocking position, a portion of the piston member extends into and blocks the front opening of the ejection chamber.

Features of the present invention include the provision of a top for containers that in a very simple, economic, and efficient manner provides a visual indicator that a container has not been previously used. Also, the top provides an ejection speed regulator so that either drops or streams can be dispensed. Further, the top, in use, is self-cleaning so that the top can be used with glue or other materials that might block a portion of the ejection chamber of the top. The top is intended for use with all kinds of liquids, regardless of the viscosity of the liquids. Controlled dispensing is accomplished by positioning a flow regulating portion of a component of the top, that is, a piston, in a desired position and inverting a container to which the top is applied.

The invention, and it objects and advantages, will become more apparent in the detailed description of the preferred embodiments hereinafter discussed.

BRIEF DESCRIPTION OF THE DRAWINGS

In the following detailed description of the preferred embodiments, reference is made to the accompanying drawings, in which.

DESCRIPTION OF THE PREFERRED EMBODIMENTS

Because closure members for containers are well known, the present description will be directed in particular to elements forming part of, or cooperating more directly with, the present invention. Elements not specifically shown or described herein are understood to be selectable from those known in the art.

Figure 1:
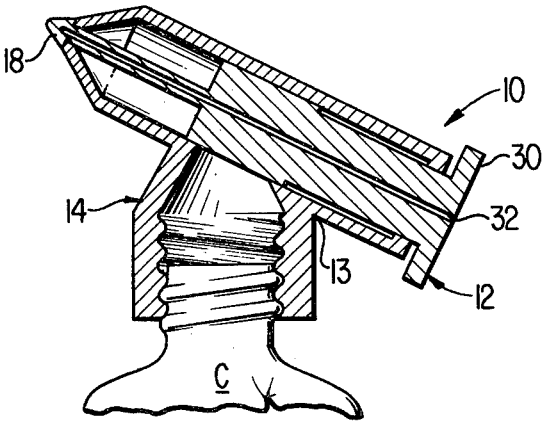
FIG. 1 is a schematic cross section of one embodiment of a top according to the present invention affixed to a container.
Figure 2:
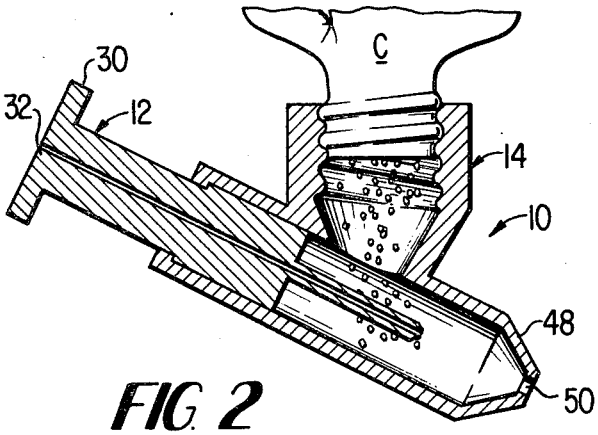
FIG. 2 is a schematic cross section of the embodiment of FIG. 1 in a dispensing position.
Figure 3:
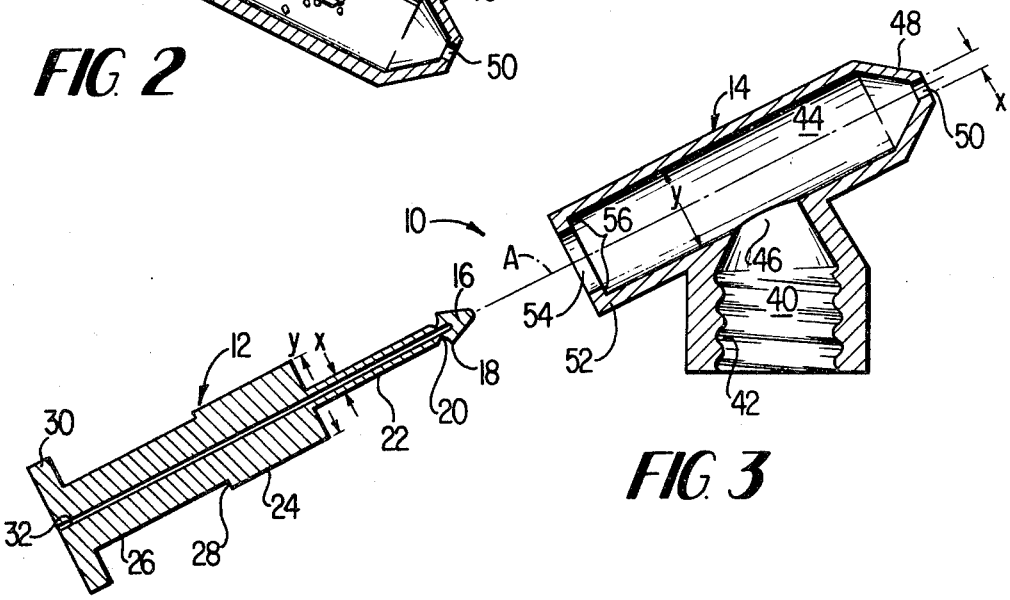
FIG. 3 is a exploded view of the components of the embodiment of FIG. 1.

Referring now to the drawings, and to FIGS. 1 to 3 in particular, a combined closure and flow regulating member or dispensing top for containers, which is generally designated 10, is illustrated. The top 10 includes a piston member, generally designated 12, and a housing 13 defining a body member, generally designated 14. The piston member 12 is a combination closure and flow or dispensing regulating member, while the body member 14 includes an ejection chamber encompassing the major portion of the piston member.

Considering the piston member in more detail, a leading or downstream end 16 of the piston member 12 has an enlarged portion 18 that extends outside of the body member. The member 18 can have any suitable shape, i.e., barbed, conical, spherical, or square. The member 18 is connected by a reduced diameter or notched portion 20 to an axially extending first intermediate portion 22 of the piston member. The first intermediate portion 22 has a predetermined diameter "X" and is connected to an enlarged diameter second intermediate or piston portion 24 having a predetermined diameter "Y", diameter "Y" being larger than diameter "X". A portion 26 of member 12 extends rearwardly from piston portion 24 and has a slightly smaller diameter that forms a step 28. Portion 26 terminates in an enlarged end 30. A bore 32 extends generally axially through the piston member 12.

Considering now the body member 14, it has a fore chamber 40 that extends generally vertically and is screw-threaded at 42 for connecting the body member to a top of a container C. Fore chamber 40 is connected to an ejection chamber 44 by a passageway or opening 46. The leading end 48 of the body member includes an opening 50, while the trailing end 52 includes an opening 54 axially aligned with opening 50. The interior diameter of a central portion of ejection chamber 44 is substantially equal to the diameter "Y" of the piston portion 24, while the diameter of opening 50 is equal to or slightly less than the diameter "X" of intermediate portion 22. The diameter of opening 54 is less than the diameter "Y" so that sides 56 of the opening engage step 28 to limit rearward movement of piston portion 24.

Preferably, the closure member is formed of plastic material so that the sides 56 of opening 54 can be distended to allow passage of piston portion 24, and the sides of opening 50 can be distended to allow passage of the enlarged portion 18. If desired, the leading portion of piston portion 22 can be tapered to facilitate the insertion of piston member 12 into ejection chamber 44 of the body member 14. Alternatively, housing 13 can be formed of two halves that are welded, glued, or otherwise sealed to each other in such manner that ejection chamber 44 encompasses piston portion 24.

Referring now to FIG. 1, it can be seen that, prior to first use of a container closed with the closure member 10, enlarged front portion 18 is positioned outside of opening 50 to provide a visual indication that the container has not been previously used. When the container is first used, rearward movement of piston member 12 causes shearing or breaking away of portion 18 from portion 22. Such breaking away is facilitated by the provision of the notched portion 20. Also, provision of the notched portion ensures that the leading end of intermediate portion 22 is sufficiently long to block passage or opening 50.

Referring now to FIG. 2, it can be seen that the position of piston portion 24 of piston member 12 controls the effective size of the passageway 46 between fore-chamber 40 and ejection chamber 44. As illustrated in FIG. 2, the piston member is in a rearmost position in which flow between the two chambers is unimpeded. The member, however, is movable into an intermediate position to reduce the effective size of passageway 46. Thus, piston member 12 acts as an ejection speed regulator, so that either drops or streams can be dispensed. Also, since the diameter of piston portion 24 is substantially equal to the interior diameter of ejection chamber 44, the piston member self-cleans the ejection chamber during movement from a flow regulating position to a blocking position. As can also be seen from FIG. 2, air is able to enter the ejection chamber 44 through the axial passageway 32 to thereby allow faster dispensing of the contents of container C.

In operation, a user of a container closed with the top 10, first grasps enlarged end 30 of member 12 and moves the member in a rearward direction to move the member from an initial blocking position to a dispensing control position. Initial movement of member 12 shears or breaks enlarged portion 18 from intermediate portion 22. Piston portion 24 is then located in such manner that a passageway of desired size is formed between fore chamber 40 and ejection chamber 44. The container C is then moved from an upright to an inverted or partially inverted discharging position to allow dispensing of the contents of the container. After the container has been inverted, its contents flow, by the force of gravity, from the container into fore chamber 40, through passageway 46 into ejection chamber 44, and out of opening 50 to a desired application or use. By moving member 12 rearward, the effective size of passageway 46 is increased to thereby increase the rate of dispensing, while moving the member forward decreases the effective size with a corresponding decrease in the ejection rate. It will be appreciated that forward movement of member 12 will result, if needed and if necesary, in an immediate, temporary increase in the dispensing rate because piston portion 24 will eject or force materials already in ejection chamber 44 out of the chamber. When it is desired to stop all dispensing, ejection member 12 is moved into a subsequent blocking position in which portion 24 blocks opening 50. Container C is then returned to its upright position.

Figure 5:
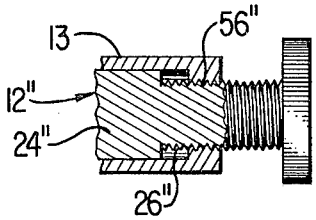
FIG. 5 is a schematic partial cross section of another embodiment of the present invention.
Figure 4:
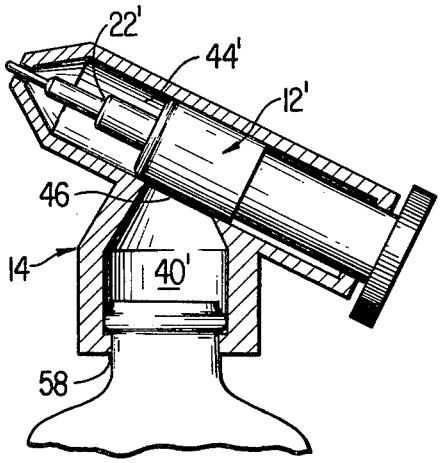
FIG. 4 is a view similar to FIG. 1 of another embodiment of the present invention.

Referring now to FIGS. 4 and 5, additional embodiments of the present invention are illustrated. With the embodiment of FIG. 4, the same reference numerals, with primes attached, have been used to identify components similar to those previously discussed. Similarly, the same reference numerals, with double primes attached, have been used with FIG. 5.

FIG. 4 illustrates an embodiment of the present invention in which a fore chamber 40′ of a body member 14′ has an inwardly extending portion 58 for press fitting the top to the top of a container C. The fore chamber 40′ is connected by a passageway or opening 46′ to an ejection chamber 44′. An axially stepped piston member 12′ is positioned for sliding movement within the ejection chamber. The piston member of this embodiment does not have an axially extending bore similar to the bore 32 of the embodiment illustrated in FIGS. 1 to 3. Also, the portion 22′ of the piston member 12′ is axially stepped to increase the rigidity or strength of the member. Preferably, the member 12′ includes a portion (not illustrated) similar to portion 18 of the embodiment of FIGS. 1 to 3. The enlarged portion has not been illustrated in FIG. 4 because FIG. 4 is intended to illustrate the piston member 12′ in a blocking position after the enlarged portion has been separated therefrom.

The embodiments of the present invention illustrated in FIGS. 1–4 have a generally vertically extending fore chamber and an ejection chamber with an axis skew to the axis of the fore chamber. Although this orientation is preferred, it is possible to have the axis of the ejection chamber perpendicular to the axis of the fore chamber. Alternatively, the fore chamber can have a skewed axis and the ejection chamber can have a horizontal axis. Further, the axis of the fore chamber can have a vertical component and a skewed component. Also, the piston and body members of the embodiments illustrated in FIGS. 1 to 4 can have complementary screw threads formed therein to allow precise positioning of the piston member to control the rate of dispensing. FIG. 5 illustrates an embodiment in which the threads are formed in rear portion 26″ of the piston member and sides 56″ of the housing 13″.

In summary, the present invention provides an improved top or closure member that is usable with all types of fluids, for instance, shampoos, medicines, kitchen oils, syrups, sauces, and chemicals. The top is also usable with all types of containers, for instance, glass and plastic containers. Since the closure and dispensing control top uses only two components, it is relatively inexpensive to manufacture. The enlarged front portion of the piston member provides a visual indication that a container has not been previously used.

The invention has been described in detail with particular reference to preferred embodiments thereof, but it will be understood that variations and modifications can be effected within the spirit and scope of the invention.

What is claimed is:

1. A combined closure and dispensing control top for closing containers and for controlling the rate of dispensing of the contents of the containers when inverted, the top comprising:

a housing defining a body member having a fore chamber connectable to the top of the container, an ejection chamber having an axis skew to an axis of the fore chamber, a passageway interconnecting the fore and ejection chambers, the ejection chamber having axially aligned front and rear openings; and a closure and dispensing control member having a piston portion disposed for sliding movement within said ejection chamber, the piston portion having an axially extending exterior configuration substantially equal to an axially extending interior configuration of the ejection chamber in the vicinity of the passageway interconnecting the fore and ejection chambers so that the effective size of the passageway is determined by the position of the piston portion, the closure and dispensing control member including an intermediate portion extending from said piston portion through said front opening, a portion extending rearwardly from said piston portion through said rear opening and terminating in an enlarged end, and an enlarged portion connected by a reduced diameter portion to said intermediate portion outside of said body member, rearward movement of said closure and dispensing control member from an initial blocking position to a dispensing control position separating said enlarged portion from said intermediate portion, said closure and dispensing control member in said dispensing control position controlling the rate of dispensing of the contents of an inverted container, said intermediate portion having an end blocking said front opening upon subsequent forward movement of said closure member.

2. A top according to claim 1, wherein said housing includes a screw-threaded portion for connecting the top to a container having a screw-threaded neck.

3. A top according to claim 1, wherein said fore chamber of said housing includes an inwardly extending portion for press fitting the top on to a neck of a container.

4. A top according to claim 1, wherein said body member and said closure and dispensing control member include complementary screw threaded portions for controlling movemment and positioning of said piston portion.

5. A top according to claim 1, wherein said closure and dispensing control member includes an axially extending bore for admitting air to said ejection chamber during dispensing of the contents of the inverted container.

6. A top according to claim 1, wherein said closure and dispensing control member is movable in a forward direction from the dispensing control position to forcibly eject contents of containers from said ejection chamber.

* * * * *